US008607482B2

(12) United States Patent
Bloxdorf

(10) Patent No.: US 8,607,482 B2
(45) Date of Patent: Dec. 17, 2013

(54) PLOW WITH PIVOTING BLADE WING(S)

(75) Inventor: David N. Bloxdorf, Hubertus, WI (US)

(73) Assignee: Douglas Dynamics, L.L.C., Milwaukee, WI (US)

( * ) Notice: Subject to any disclaimer, the term of this patent is extended or adjusted under 35 U.S.C. 154(b) by 471 days.

(21) Appl. No.: 13/036,882

(22) Filed: Feb. 28, 2011

(65) Prior Publication Data

US 2012/0216434 A1 Aug. 30, 2012

(51) Int. Cl.
*E01H 5/04* (2006.01)

(52) U.S. Cl.
USPC ..... 37/274

(58) Field of Classification Search
USPC ..... 37/281, 274, 241, 282, 283, 234, 232, 37/266, 279; 172/782, 786, 815, 816, 172/684.5
See application file for complete search history.

(56) References Cited

U.S. PATENT DOCUMENTS

| | | | |
|---|---|---|---|
| 595,202 | A | 12/1897 | Pearson et al. |
| 1,927,078 | A | 9/1933 | Weeks |
| 2,218,512 | A | 10/1940 | Ball |
| 2,299,451 | A | 10/1942 | Austin |
| 2,410,543 | A | 11/1946 | Kester |
| 2,524,329 | A | 10/1950 | Richardson |
| 2,643,470 | A | 6/1953 | Kaeser |
| 3,157,099 | A | 11/1964 | Ulrich |
| 3,250,026 | A | 5/1966 | Jocher et al. |
| 3,302,317 | A | 2/1967 | Domres |
| 3,378,084 | A | 4/1968 | Ulrich |
| 3,425,497 | A | 2/1969 | Strabala et al. |

(Continued)

FOREIGN PATENT DOCUMENTS

| | | |
|---|---|---|
| DE | 919474 | 7/1949 |
| EP | 140139 | 5/1985 |
| GB | 1037674 | 8/1966 |
| SE | 323974 | 5/1970 |

OTHER PUBLICATIONS

Farm Industry News, vol. 23, No. 7, Jul./Aug. 1990, p. 25.

(Continued)

*Primary Examiner* — Robert Pezzuto
(74) *Attorney, Agent, or Firm* — Wood, Herron & Evans, LLP

(57) ABSTRACT

A plow assembly for attachment to a vehicle, the vehicle having a longitudinal axis, comprises a plow blade having first and second ends, a first plow wing pivotally mounted to the first end of the plow blade, a plow support adapted to be mounted to the vehicle, the plow blade being pivotally mounted to the plow support to permit the plow blade to pivot relative to the vehicle between a center position, where the plow blade is positioned generally perpendicular to the longitudinal axis of the vehicle, and a first position, where the first end of the plow blade is pivoted toward the vehicle, and between the center position and a second position, where the second end of the plow blade is pivoted toward the vehicle, and either a single link rod, a resilient connecting member, or a cam and follower mechanism connected to the first plow wing and to the plow support and configured to pivot the first plow wing relative to the plow blade during pivoting of the plow blade relative to the vehicle such that when the plow blade is in the center position the first plow wing is angled forwardly relative to the plow blade, when the plow blade is in the first position the first plow wing is generally parallel to the plow blade, and when the plow blade is in the second position the first plow wing is angled forwardly relative to the plow blade.

52 Claims, 15 Drawing Sheets

(56) References Cited

U.S. PATENT DOCUMENTS

| | | | |
|---|---|---|---|
| 3,430,706 | A | 3/1969 | Marron |
| 3,477,151 | A | 11/1969 | Zanella |
| 3,657,828 | A | 4/1972 | Anderson |
| 3,775,877 | A | 12/1973 | Gove, Sr. |
| 3,803,733 | A | 4/1974 | Ramsey |
| 3,807,064 | A | 4/1974 | Schmidt et al. |
| 4,019,268 | A | 4/1977 | Waterman |
| 4,073,077 | A | 2/1978 | Essel et al. |
| 4,074,448 | A | 2/1978 | Niemela |
| 4,099,578 | A | 7/1978 | Stevens |
| 4,145,825 | A | 3/1979 | Bertolino |
| 4,196,532 | A | 4/1980 | Muller |
| 4,249,323 | A | 2/1981 | Mathis et al. |
| 4,275,514 | A | 6/1981 | Maura |
| RE3,104 | E | 10/1982 | Essell et al. |
| 4,356,645 | A | 11/1982 | Hine et al. |
| 4,369,847 | A | 1/1983 | Mizunuma |
| 4,372,617 | A | 2/1983 | Zamboni |
| 4,479,312 | A | 10/1984 | Turgeon |
| 4,614,048 | A | 9/1986 | Melby |
| 4,658,519 | A | 4/1987 | Quenzi |
| 4,667,426 | A | 5/1987 | Howard et al. |
| 4,723,609 | A | 2/1988 | Curtis |
| 4,779,363 | A | 10/1988 | Boutrais et al. |
| 4,834,191 | A | 5/1989 | Vecchio |
| 4,962,600 | A | 10/1990 | Zellaha et al. |
| 5,165,191 | A | 11/1992 | Davis |
| 5,285,588 | A | 2/1994 | Niemela et al. |
| 5,375,349 | A | 12/1994 | Jochim |
| 5,392,538 | A | 2/1995 | Geerligs et al. |
| 5,411,102 | A | 5/1995 | Nickels et al. |
| 5,638,618 | A | 6/1997 | Niemela et al. |
| 5,829,174 | A | 11/1998 | Hadler et al. |
| 5,899,007 | A | 5/1999 | Niemela et al. |
| 5,903,986 | A | 5/1999 | Parker |
| 6,178,669 | B1 | 1/2001 | Quenzi et al. |
| 6,276,076 | B1 | 8/2001 | Quenzi et al. |
| 6,393,737 | B2 | 5/2002 | Quenzi et al. |
| 6,408,549 | B1 | 6/2002 | Quenzi et al. |
| 6,412,199 | B1 | 7/2002 | Quenzi et al. |
| 6,442,877 | B1 | 9/2002 | Quenzi et al. |
| 6,463,683 | B1 | 10/2002 | Skwarchuk |
| 6,615,513 | B2 | 9/2003 | Quenzi et al. |
| 7,134,227 | B2 | 11/2006 | Quenzi et al. |

OTHER PUBLICATIONS

"Still Out in Front in Productivity," Excel Industries, Inc., copyright 1988.

"Snow Track 440," Excel Industries, 1989.

PLOW WITH PIVOTING BLADE WING(S)

RELATED APPLICATIONS

N/A

FIELD

The subject matter herein relates generally to plows, and more particularly to snow plows of the type having a wing mounted for pivoting movement on one or both of the ends of the blade of the snow plow.

BACKGROUND

Snow plows of the type having a wing mounted for pivoting movement on one or both of the ends of the blade of the snow plow are known. One example of such a plow is shown and described in U.S. Pat. No. 7,134,227, assigned to the assignee of the present invention, and hereby incorporated by reference herein. The '227 patent discloses a plow having a plow blade and a pair of plow wings pivotally mounted at opposite ends of the plow blade. The wings are pivotable between a forwardly angled position relative to the plow blade and an aligned position relative to the plow blade. Various mechanisms, both mechanical and hydraulic, are provided for pivoting the trailing wing from the forwardly angled position to the aligned position as the blade end to which the trailing wing is mounted is pivoted toward the vehicle.

It is desirable to provide an improved plow with pivoting blade wing(s).

SUMMARY

In one aspect, a plow assembly for attachment to a vehicle, the vehicle having a longitudinal axis, comprises a plow blade having first and second ends, a first plow wing pivotally mounted to the first end of the plow blade, a plow support adapted to be mounted to the vehicle, the plow blade being pivotally mounted to the plow support to permit the plow blade to pivot relative to the vehicle between a center position, where the plow blade is positioned generally perpendicular to the longitudinal axis of the vehicle, and a first position, where the first end of the plow blade is pivoted toward the vehicle, and between the center position and a second position, where the second end of the plow blade is pivoted toward the vehicle, and a first connecting member connected to the first plow wing and to the plow support, the first connecting member configured to pivot the first plow wing relative to the plow blade during pivoting of the plow blade relative to the vehicle such that when the plow blade is in the center position the first plow wing is angled forwardly relative to the plow blade, when the plow blade is in the first position the first plow wing is generally parallel to the plow blade, and when the plow blade is in the second position the first plow wing is angled forwardly relative to the plow blade, the first connecting member comprising a first single link rod directly connected to the first plow wing and to the plow support.

The first single link rod can have a first end connected to the plow support at a location forward of a pivot axis of the plow blade and between the pivot axis of the plow blade and the first end of the plow blade, and a second end connected to the first plow wing at a location rearward of a pivot axis of the first plow wing.

In another aspect, a plow assembly for attachment to a vehicle, the vehicle having a longitudinal axis, comprises a plow blade having first and second ends, a first plow wing pivotally mounted to the first end of the plow blade, a plow support adapted to be mounted to the vehicle, the plow blade being pivotally mounted to the plow support to permit the plow blade to pivot relative to the vehicle between a center position, where the plow blade is positioned generally perpendicular to the longitudinal axis of the vehicle, and a first position, where the first end of the plow blade is pivoted toward the vehicle, and between the center position and a second position, where the second end of the plow blade is pivoted toward the vehicle, and a first connecting member operably connected to the first plow wing and to the plow support, the first connecting member configured to pivot the first plow wing relative to the plow blade during pivoting of the plow blade relative to the vehicle such that when the plow blade is in the center position said first plow wing is angled forwardly relative to the plow blade, when the plow blade is in said first position the first plow wing is generally parallel to the plow blade, and when the plow blade is in the second position the first plow wing is angled forwardly relative to the plow blade, the first connecting member comprising a first resilient connecting member such that when the first plow wing contacts an obstacle during forward movement of the vehicle, the first resilient connecting member shortens to allow the first plow wing to pivot toward the plow support until such time as the first plow wing no longer contacts the obstacle at which time the first resilient connecting member lengthens to pivot the first plow wing away from the plow support.

The first resilient connecting member can comprise a first link having first and second ends, a second link having first and second ends, the first end of the first link connected to the plow support, the first end of the second link connected to the first wing, the second ends of the first and second links movably connected to each other such that the first resilient connecting member has a longer length and a shorter length, and a compression spring operable between the second ends of the first and second links. The first link can comprise a link rod having a threaded end and a spring seat spaced from the threaded end, the second link can comprise a spring guide having a tube and a clevis attached to an end of the tube, the tube and clevis positioned to telescope over the link rod such that the threaded end of the link rod extends out of the tube and a base of the clevis, and a nut threaded on the threaded end of the link rod and abutting one side of the base of the clevis, the compression spring positioned over the tube of the spring guide, one end of the compression spring abutting the other side of the base of the clevis, the other end of the compression spring abutting the spring seat of the link rod.

In another aspect, a plow assembly for attachment to a vehicle, the vehicle having a longitudinal axis, comprises a plow blade having first and second ends, a first plow wing pivotally mounted to the first end of the plow blade, a plow support adapted to be mounted to the vehicle, the plow blade being pivotally mounted to the plow support to permit the plow blade to pivot relative to the vehicle between a center position, where the plow blade is positioned generally perpendicular to the longitudinal axis of the vehicle, and a first position, where the first end of the plow blade is pivoted toward the vehicle, and between the center position and a second position, where the second end of the plow blade is pivoted toward the vehicle, and a first connecting member operably connected to the first plow wing and to the plow support, the first connecting member configured to pivot the first plow wing relative to the plow blade during pivoting of the plow blade relative to the vehicle such that when the plow blade is in the center position the first plow wing is angled forwardly relative to the plow blade, when the plow blade is in the first position the first plow wing is generally parallel to the plow blade, and when the plow blade is in the second position the first plow wing is angled forwardly relative to the plow blade, the first connecting member comprising a first cam and follower mechanism.

The first cam and follower mechanism can comprise a cam pivotally mounted to the plow blade, a cam follower mounted on the first plow wing, and a link having a first end connected to the plow support and having a second end connected to the cam. The first cam and follower mechanism can also comprise a cam pivotally mounted to the plow blade, a cam follower, a cam link having a first end connected to the plow support and having a second end connected to the cam, and a follower link having a first end connected to the first plow wing and having a second end connected to the cam follower. For either mechanism the cam can include an arcuate slot therein defining a cam profile, and the cam follower can be a pin positioned in the slot.

In another aspect, a plow assembly for attachment to a vehicle, the vehicle having a longitudinal axis, comprises a plow blade having first and second ends, a first plow wing pivotally mounted to the first end of the plow blade, a plow support adapted to be mounted to the vehicle, the plow blade being pivotally mounted to the plow support to permit the plow blade to pivot relative to the vehicle between a center position, where the plow blade is positioned generally perpendicular to the longitudinal axis of the vehicle, and a first position, where the first end of the plow blade is pivoted toward the vehicle, and between the center position and a second position, where the second end of the plow blade is pivoted toward the vehicle, a first cam and follower mechanism operably connected to the first plow wing and to the plow support, the first cam and follower mechanism configured to pivot the first plow wing relative to the plow blade during pivoting of the plow blade relative to the vehicle such that when the plow blade is in the center position the first plow wing is angled forwardly relative to the plow blade, when the plow blade is in the first position the first plow wing is generally parallel to the plow blade, and when the plow blade is in the second position the first plow wing is angled forwardly relative to the plow blade, and a first resilient connecting member operably connected between either the first cam and follower mechanism and the plow support, or between the first cam and follower mechanism and the first plow wing, the first resilient connecting member configured such that when the first plow wing contacts an obstacle during forward movement of the vehicle, the first resilient connecting member shortens to allow the first plow wing to pivot toward the plow support until such time as the first plow wing no longer contacts the obstacle at which time the first resilient connecting member lengthens to pivot the first plow wing away from the plow support.

For any of the above plow assemblies: The plow support can comprise an A-frame having a forward end and a rearward end, the plow blade pivotally mounted to the forward end of the A-frame, the rearward end of the A-frame adapted to be mounted to the vehicle. The first plow wing can be angled forwardly relative to the plow blade by a greater degree when the plow blade is in the second position than when the plow blade is in the center position. For example, the first plow wing can be angled forwardly relative to the plow blade by an angle of about 33 degrees relative to the plow blade when the plow blade is in the center position, and the first plow wing can be angled forwardly relative to the plow blade by an angle of about 42 degrees relative to the plow blade when the plow blade is in the second position. The plow assembly can further comprise a first actuator connected to the plow blade and to the plow support, the first actuator connected to the plow blade at a location between a pivot axis of the plow blade and the first end of the plow blade. The plow assembly can further comprise a second plow wing pivotally mounted to the second end of the plow blade, and a second connecting member connected to the second plow wing and to the plow support. The plow assembly can further comprise a second actuator connected to the plow blade and to the plow support, the second actuator connected to the plow blade at a location between a pivot axis of the plow blade and the second end of the plow blade.

DRAWINGS

DESCRIPTION

Figure 1:
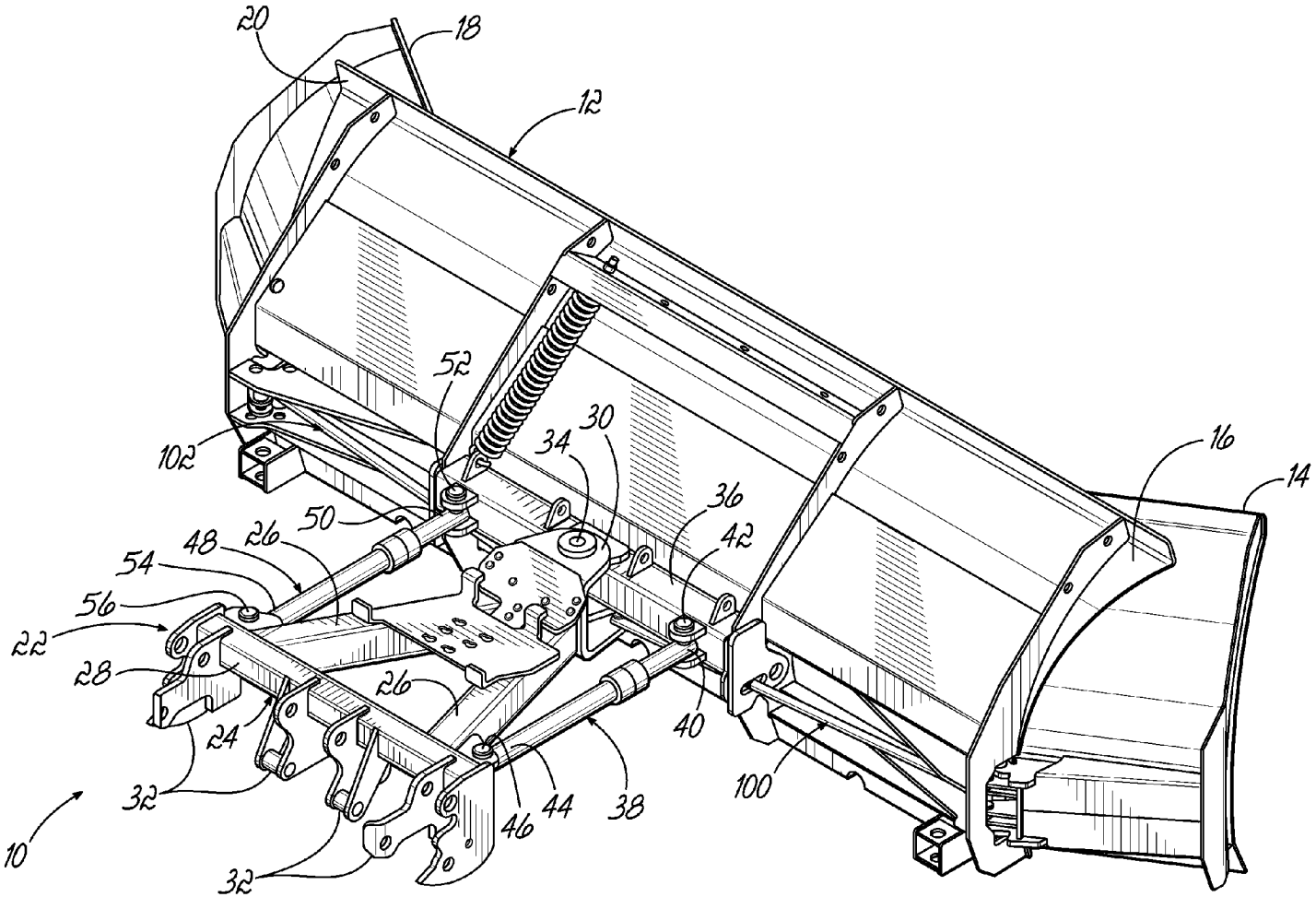
FIG. 1 is a rear perspective view of a plow assembly illustrating the plow blade positioned generally perpendicular to the longitudinal axis of the vehicle and the first and second wings angled forwardly relative to the plow blade, and utilizing a single link rod to directly connect each of the first and second plow wings to the plow support.

Referring to FIG. 1, a plow assembly 10 for attachment to a vehicle, the vehicle having a longitudinal axis, is shown. The plow assembly 10 comprises a plow blade 12, a first plow wing 14 pivotally mounted to a first end 16 of the plow blade 12, and a second plow wing 18 pivotally mounted to a second end 20 of the plow blade 12. While two plow wings are illustrated, it is to be understood that the invention can be practiced with just one such plow wing, and thus the invention is not to be limited as requiring two plow wings.

Figure 2A:
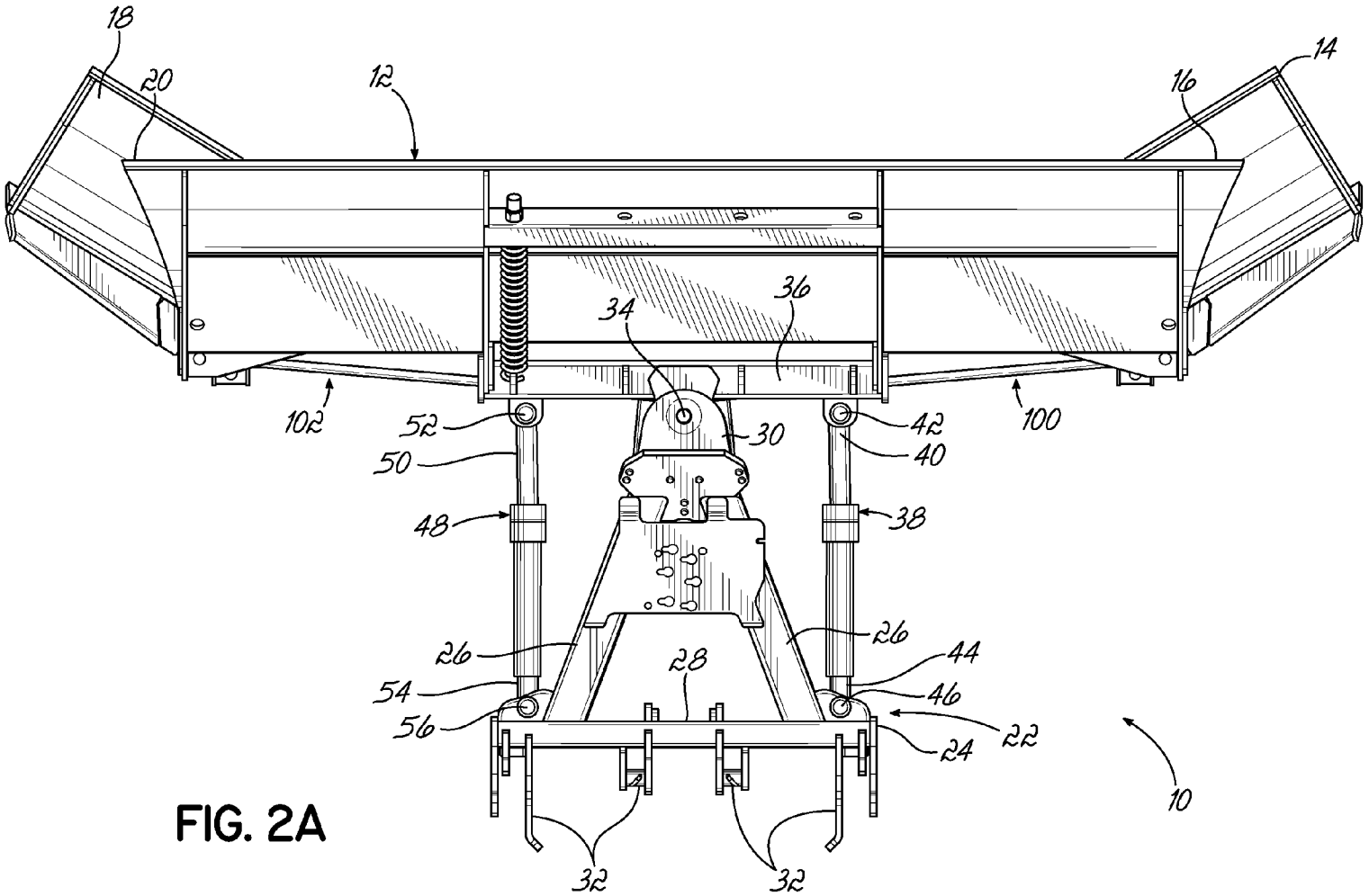
FIG. 2A is a top view of the plow assembly of FIG. 1.
Figure 2B:
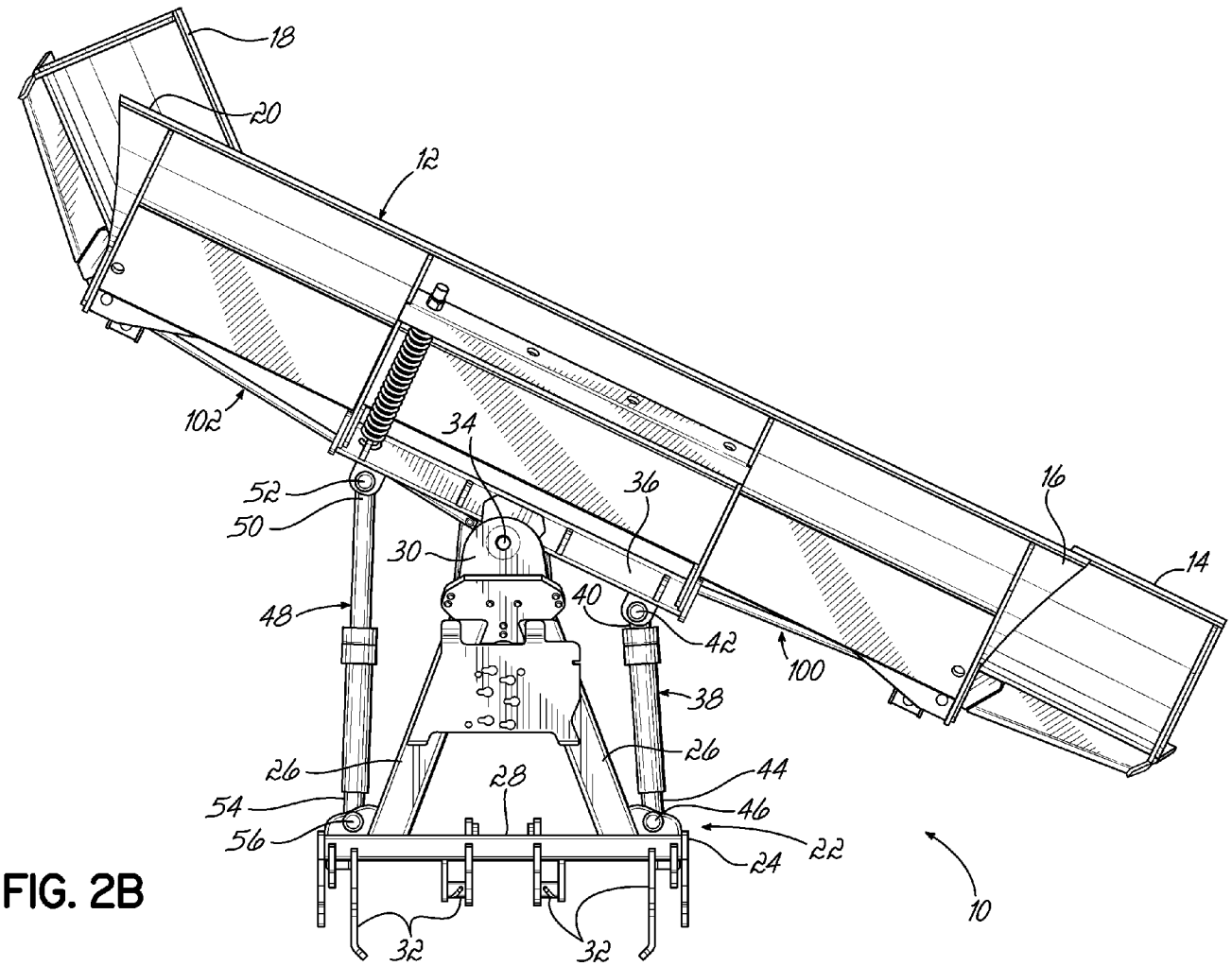
FIG. 2B is a top view of the plow assembly of FIGS. 1 and 2A with the plow blade pivoted to the first position where the first end of the plow blade is pivoted toward the vehicle, the first plow wing is generally parallel to the plow blade, and the second plow wing is angled forwardly relative to the plow blade.
Figure 2C:
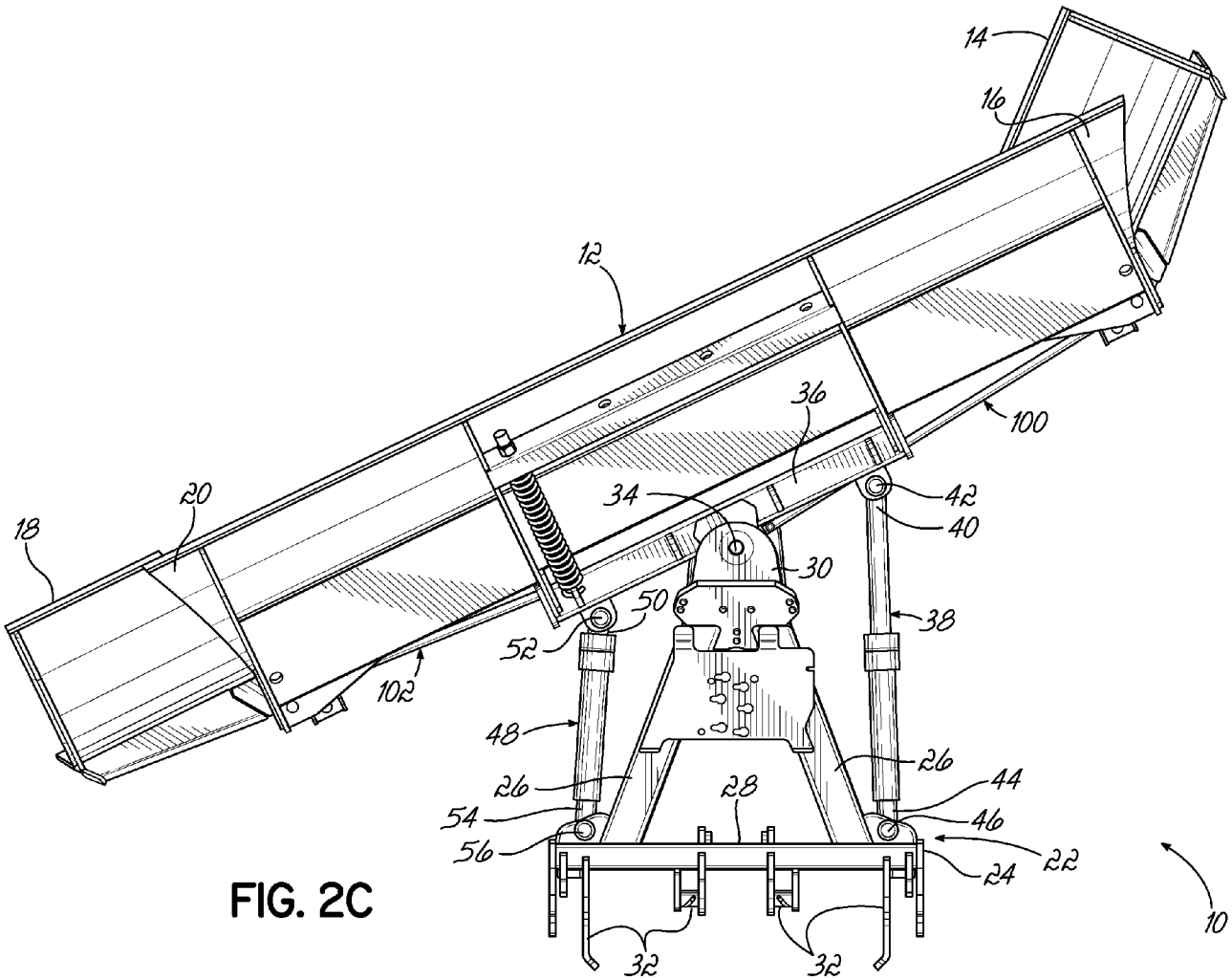
FIG. 2C is a top view of the plow assembly of FIGS. 1, 2A, and 2B with the plow blade pivoted to the second position where the second end of the plow blade is pivoted toward the vehicle, the first plow wing is angled forwardly relative to the plow blade, and the second plow wing is generally parallel to the plow blade.
Figure 3A:
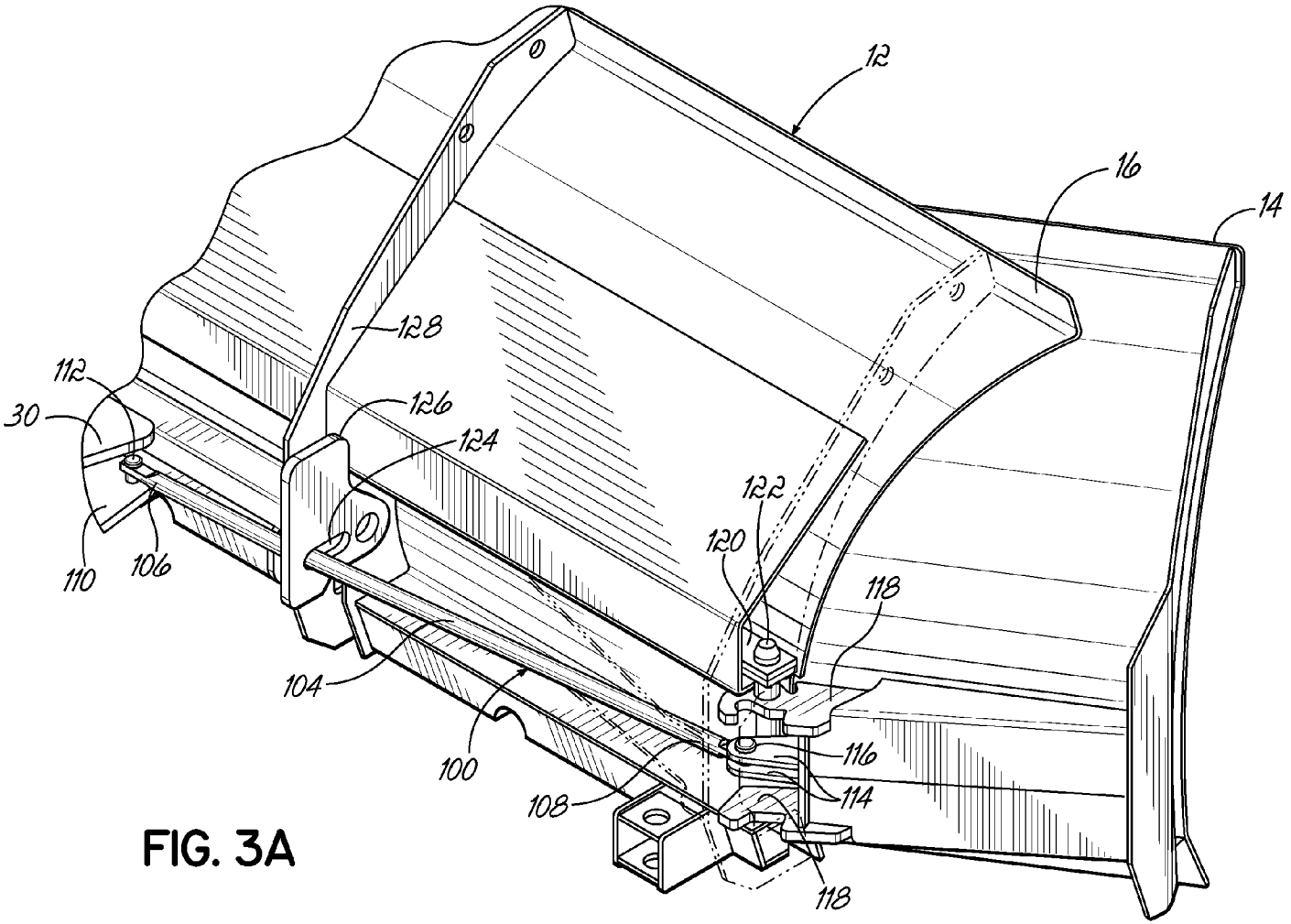
FIG. 3A is an enlarged rear perspective view of the first end of the plow blade and the first plow wing of the plow assembly of FIGS. 1, 2A, 2B, and 2C, the first plow wing angled forwardly relative to the plow blade.
Figure 3B:
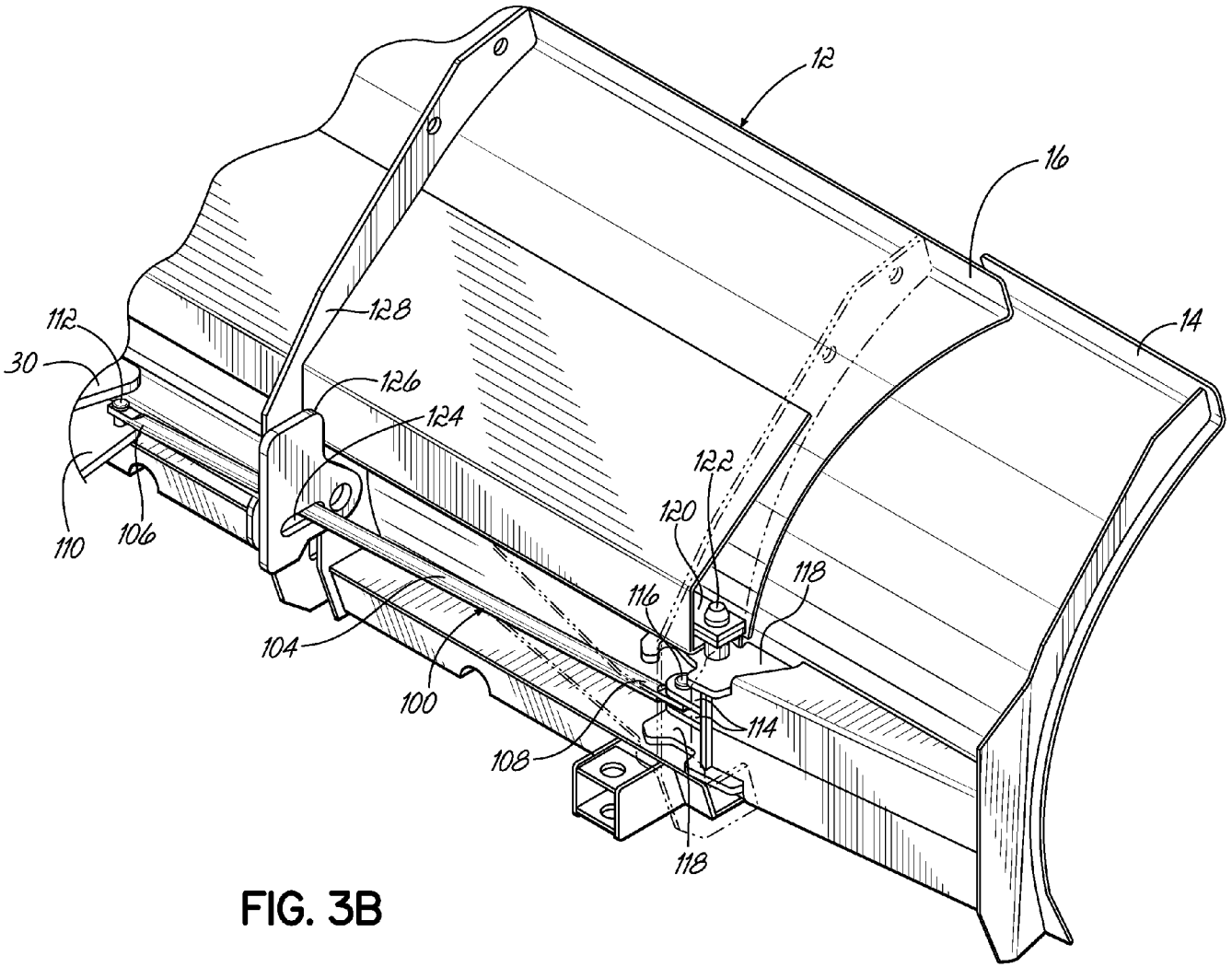
FIG. 3B is a view similar to FIG. 3A but with the first plow wing generally parallel to the plow blade.

Referring to FIGS. 1, 2A, 2B, and 2C, the plow assembly 10 further comprises a plow support 22 adapted to be mounted to the vehicle, the plow blade 12 being pivotally mounted to the plow support 22. Plow support 22 can be, for example, an "A-frame" 24 having legs 26, 26 connected by a base 28 on their rearward ends and having forward ends connected together. A large clevis 30 can be connected to the forward ends of the legs 26, 26. The base 28 can include various mounting structures 32 which interface with a mount frame (not shown) that is mounted to the frame of the vehicle. A pivot pin 34 pivotally mounts the plow blade 12, for example a pivot beam 36 on the rear side of the plow blade 12, to the clevis 30. The plow assembly 10 can further comprise a first actuator 38, for example hydraulic cylinder, connected to the plow blade 12 and to the plow support 22. The first actuator 38 has a first end 40 pivotally connected to the pivot beam 34 of the plow blade 12 with a pin 42 located between the pivot axis of the plow blade 12 and the first end 16 of the plow blade 12, and a second end 44 pivotally connected to the A-frame 24 with a pin 46. The plow assembly 10 can further comprise a second actuator 48, for example hydraulic cylinder, connected to the plow blade 12 and to the plow support 22. The second actuator 48 has a first end 50 pivotally connected to the pivot beam 34 of the plow blade 12 with a pin 52 located between the pivot axis of the plow blade 12 and the second end 20 of the plow blade 12, and a second end 54 pivotally connected to the A-frame 24 with a pin 56. The plow blade 12 is thus pivotal relative to the vehicle between a center position, where the plow blade 12 is positioned generally perpendicular to the longitudinal axis of the vehicle (FIG. 2A), and a first position, where the first end 16 of the plow blade 12 is pivoted toward the vehicle (FIG. 2B), and between the center position and a second position, where the second end 20 of the plow blade 12 is pivoted toward the vehicle (FIG. 2C).

Referring to FIGS. 1, 2A, 2B, 2C, 3A, and 3B, the plow assembly 10 further comprises a first connecting member 100 connected to the first plow wing 14 and to the plow support 22. In the event that the plow assembly 10 includes both a first plow wing 14 and a second plow wing 18, then the plow assembly 10 would further comprise a second connecting member 102 connected to the second plow wing 18 and to the plow support 22. As the first and second connecting members 100, 102 are substantially the same, only one of the connecting members, the first connecting member 100, will be described in detail.

The first connecting member 100 is configured to pivot the first plow wing 14 relative to the plow blade 12 during pivoting of the plow blade 12 relative to the vehicle such that when the plow blade 12 is in the center position (FIGS. 1 and 2A), the first plow wing 14 is angled forwardly relative to the plow blade 12, when the plow blade 12 is in the first position, the first plow wing 14 is generally parallel to the plow blade 12 (FIG. 2B), and when the plow blade 12 is in the second position, the first plow wing 14 is angled forwardly relative to the plow blade 12 (FIG. 2C). The first connecting member 100 comprises a single link rod 104 directly connected to the first plow wing 14 and to the plow support 22. Single link rod 104 has a first end 106 and a second end 108. First end 106 can be pivotally connected to a lower plate 110 of clevis 30 with a pin 112. Second end 108 can be pivotally connected to a pair of ears 114, 114 of the first plow wing 14 with a pin 116.

The length of the single link rod 104 and the location of the connections of its ends 106, 108 relative to the pivot axis of the plow blade 12 and the pivot axis of the plow wing 14 can be selected to produce the desired motion of the plow wing 14 during pivoting of the plow blade 12. For example, the connecting member 100 can be configured such that the first plow wing 14 is angled forwardly relative to the plow blade 12 by an angle of about 33 degrees relative to the plow blade 12 when the plow blade 12 is in the center position (FIG. 2A), and such that the first plow wing 14 is angled forwardly relative to the plow blade 12 by an angle of about 42 degrees relative to the plow blade 12 when the plow blade 12 is in the second position (FIG. 2C). For example, the first end 106 of the single link rod 104 can be connected to the plow support 22 at a location forward of the pivot axis of the plow blade 12 and between the pivot axis of the plow blade 12 and the first end 16 of the plow blade 12, and the second end 108 of the single link rod 104 can be connected to the first plow wing 14 at a location rearward of the pivot axis of the first plow wing 14. To pivotally mount the first plow wing 14 to the plow blade 12, first plow wing 14 can have a pair of ears 118, 118 that are pivotally connected to a pair of ribs 120, 120 (only one of which is shown) on the plow blade 12 with a pin 122. Single link rod 104 can be supported in a slot 124 of a bracket 126 attached to a rib 128 of the plow blade 12.

Referring now to FIGS. 4A, 4B, 4C, and 4D, another connecting member 200 is illustrated that is configured to pivot the first plow wing 14 relative to the plow blade 12 during pivoting of the plow blade 12 relative to the vehicle as shown in FIGS. 2A, 2B, and 2C. Connecting member 200 comprises a resilient connecting member 202 which provides a "trip" function for the first plow wing 14. When the first plow wing 14 contacts an obstacle during forward movement of the vehicle, the resilient connecting member 202 shortens to allow the first plow wing 14 to pivot toward the plow support 22. Once the first plow wing 14 is past the obstacle or otherwise is no longer contacting the obstacle, the resilient connecting member 202 lengthens to pivot the first plow wing 14 away from the plow support 22.

Figure 4A:
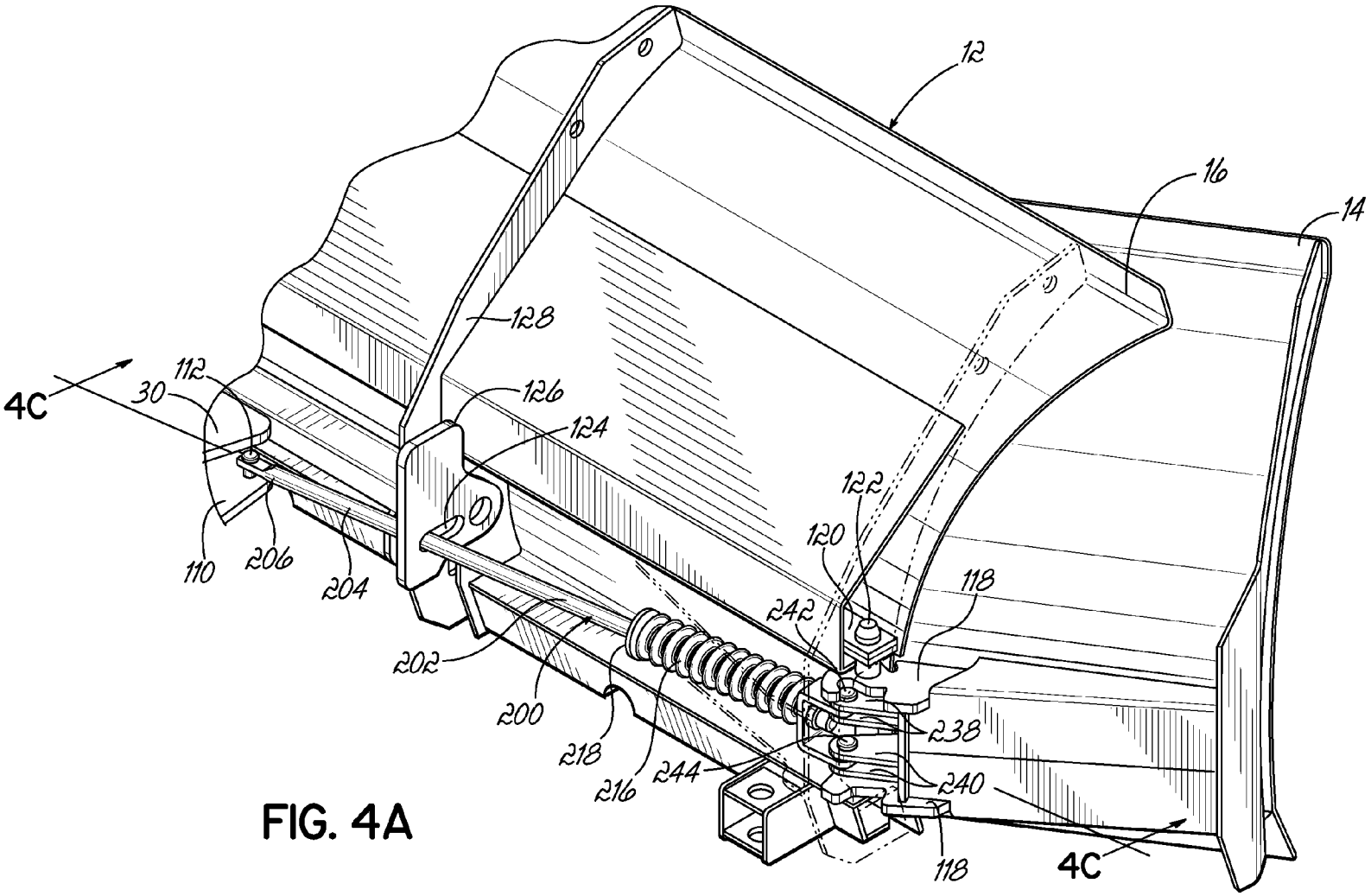
FIG. 4A is an enlarged rear perspective view of the first end of the plow blade and the first plow wing utilizing a resilient connecting member to operably connect the first plow wing to the plow support, the first plow wing angled forwardly relative to the plow blade.
Figure 4B:
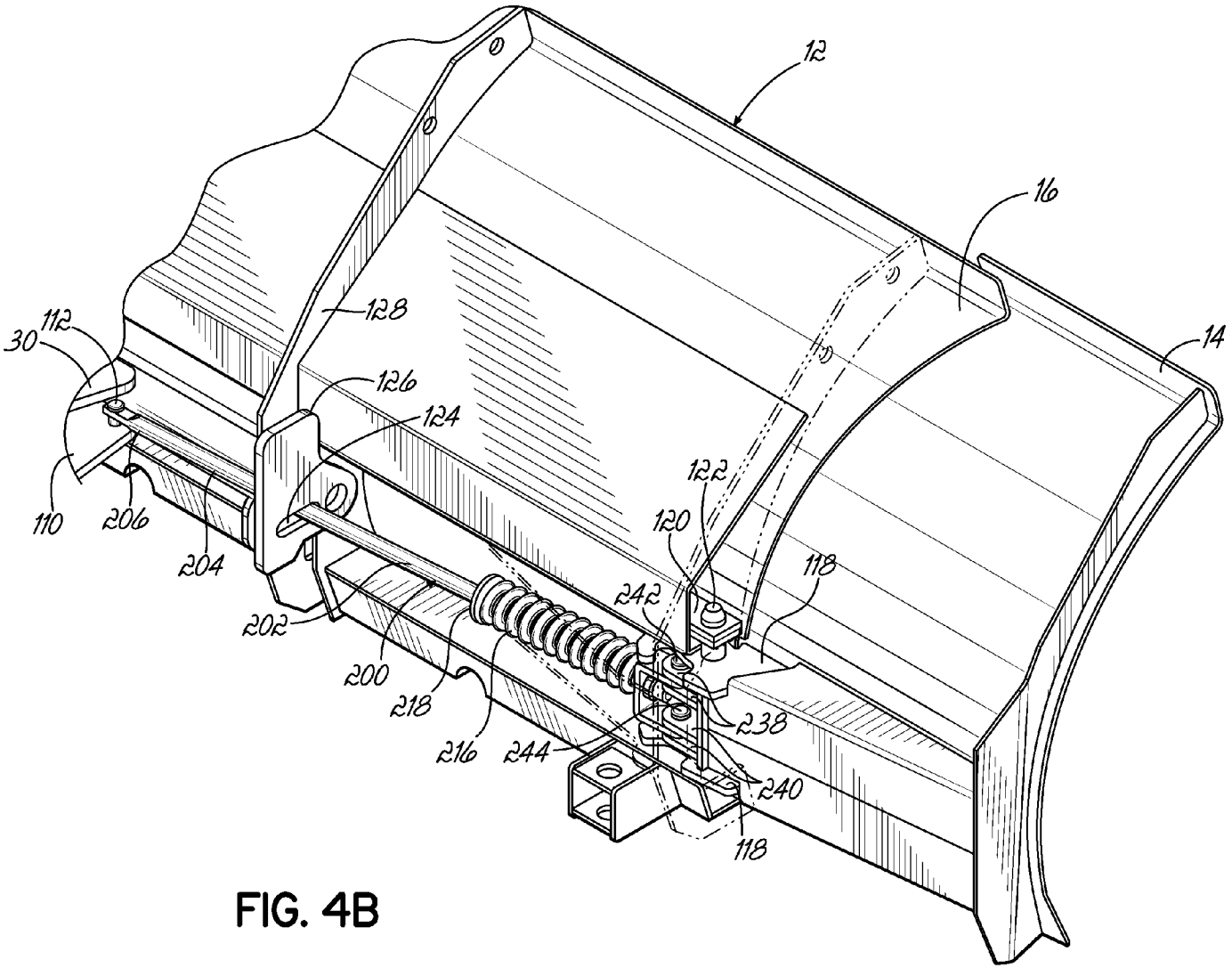
FIG. 4B is a view similar to FIG. 4A but with the first plow wing generally parallel to the plow blade.
Figure 4C:
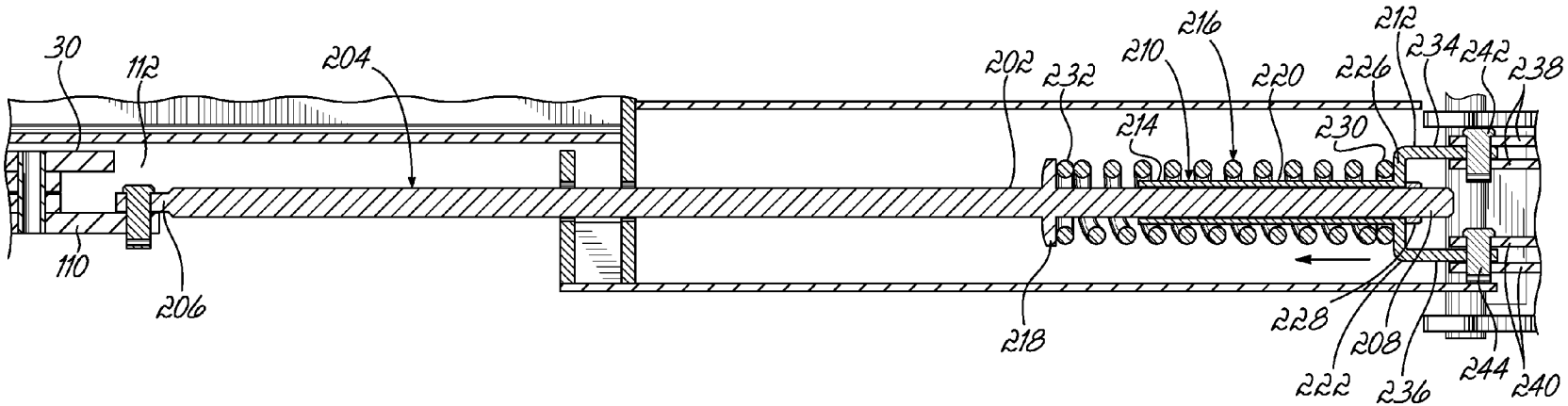
FIG. 4C is a cross-sectional view taken along line 4C-4C in FIG. 4A.
Figure 4D:
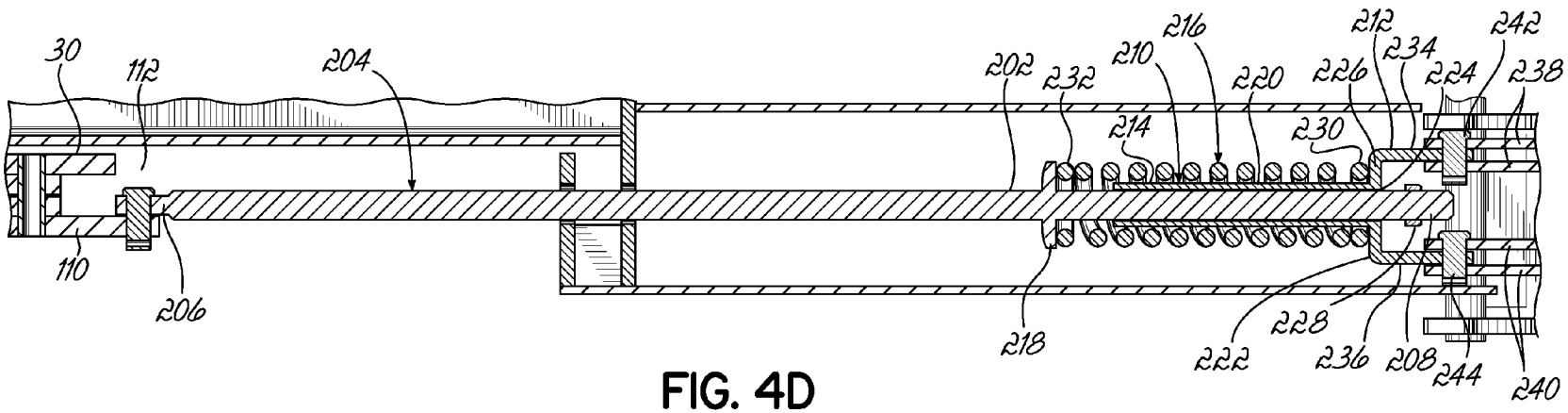
FIG. 4D is a view similar to FIG. 4C illustrating pivoting of the first plow wing toward the plow support and resulting compression of the resilient connecting member as if the first plow wing had contacted an obstacle during forward movement of the vehicle.

The resilient connecting member 202 can comprise a first link 204 having a first end 206 and a second end 208, and a second link 210 having a first end 212 and a second end 214. The first end 206 of the first link can be connected to the plow support 22, for example pivotally connected to the lower plate 110 of clevis 30 with pin 112, and the first end 212 of the second link 210 can be connected to the first wing 14. The second ends 208, 214 of the first and second links 204, 210, respectively, are movably connected to each other such that the resilient connecting member 202 has a longer length (FIG. 4C) and a shorter length (FIG. 4D). A compression spring 216 is operable between the second ends 208, 214 of the first and second links 204, 210, respectively.

For example, the first link 204 can comprise a link rod, the end 208 of which is threaded, and having spring seat 218 spaced from the threaded end 208. For example, the second link 210 can comprise a spring guide having a tube 220 and a clevis 222 attached to an end of the tube 220. The tube 220 and clevis 222 are positioned to telescope over the link rod 204 such that the threaded end 208 of the link rod 204 extends out of the tube 220 and through a hole 224 in a base 226 of the clevis 222. A nut 228 is threaded on the threaded end 208 of the link rod 204 and abuts one side of the base 226 of the clevis 222. The compression spring 216 is positioned over the tube 220 of the spring guide 210. One end 230 of the compression spring 216 abuts the other side of the base 226 of the clevis 222, and the other end 232 of the compression spring 216 abuts the spring seat 218 of the link rod 204. The clevis 222 has a pair of sides 234, 236. The first plow wing 14 has two pairs of ears 238, 238 and 240, 240. One of the sides 234 of the clevis 222 is pivotally connected to one of the pairs of ears 238, 238 with pin 242, and the other of the sides 236 of the clevis 222 is pivotally connected to the other of the pairs of ears 240, 240 with pin 244. Compression spring 216 is preloaded between spring seat 218 and clevis 222 by tightening nut 228 on threaded end 208 to develop the desired preload force in the spring 216. Unless the force applied by the first plow wing 14 to the spring 216 through clevis 222 due to the first plow wing 14 striking an obstacle during forward movement of the vehicle exceeds the preload force in the spring 216, the link rod 204, spring guide 210, and spring 216 act as a rigid link, pivoting the first plow wing 14 relative to the plow blade 12 during pivoting of the plow blade 12 relative to the vehicle as shown in FIGS. 2A, 2B, and 2C.

Figure 5A:
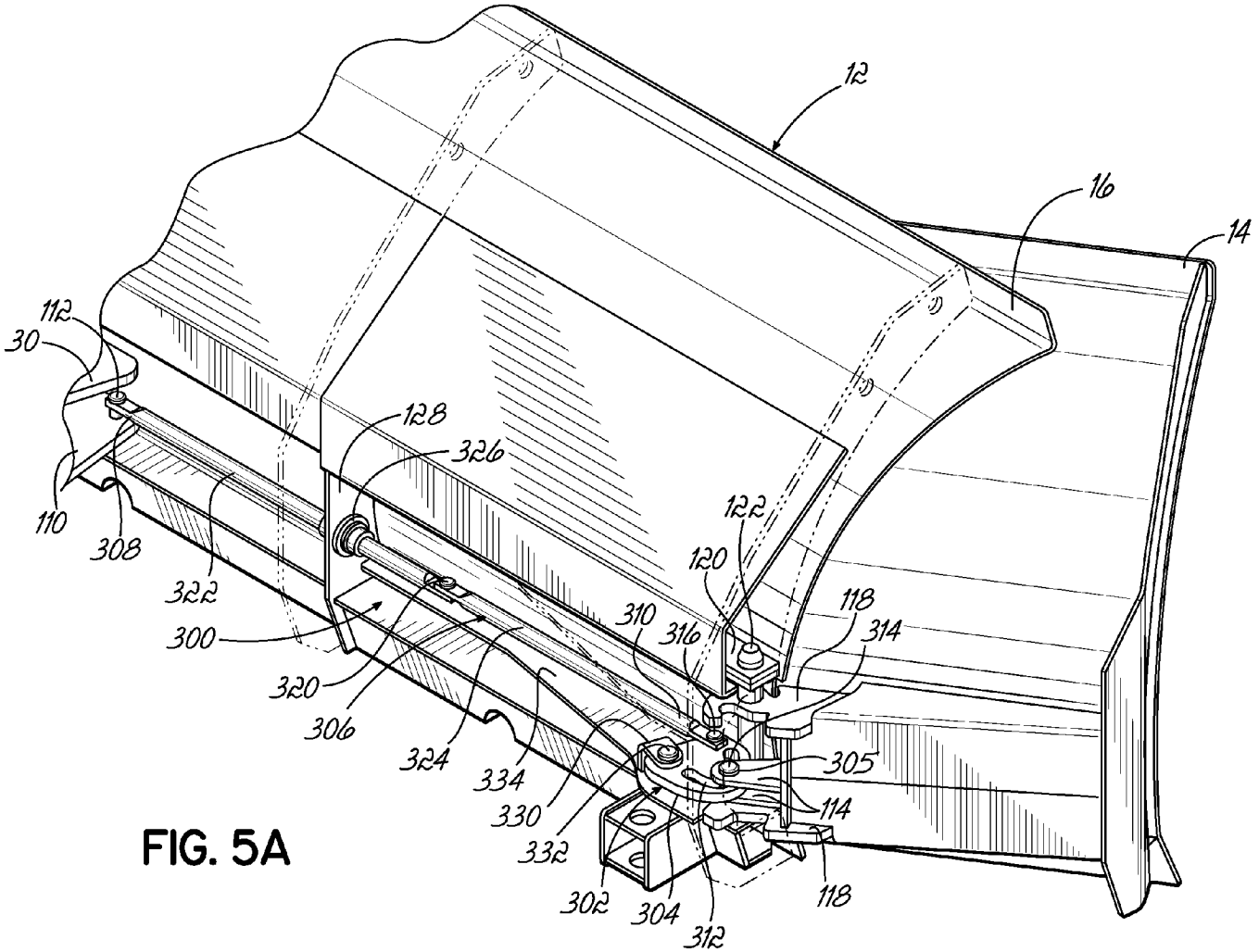
FIG. 5A is an enlarged rear perspective view of the first end of the plow blade and the first plow wing utilizing a cam and follower mechanism to operably connect the first plow wing to the plow support, the first plow wing angled forwardly relative to the plow blade.
Figure 5B:
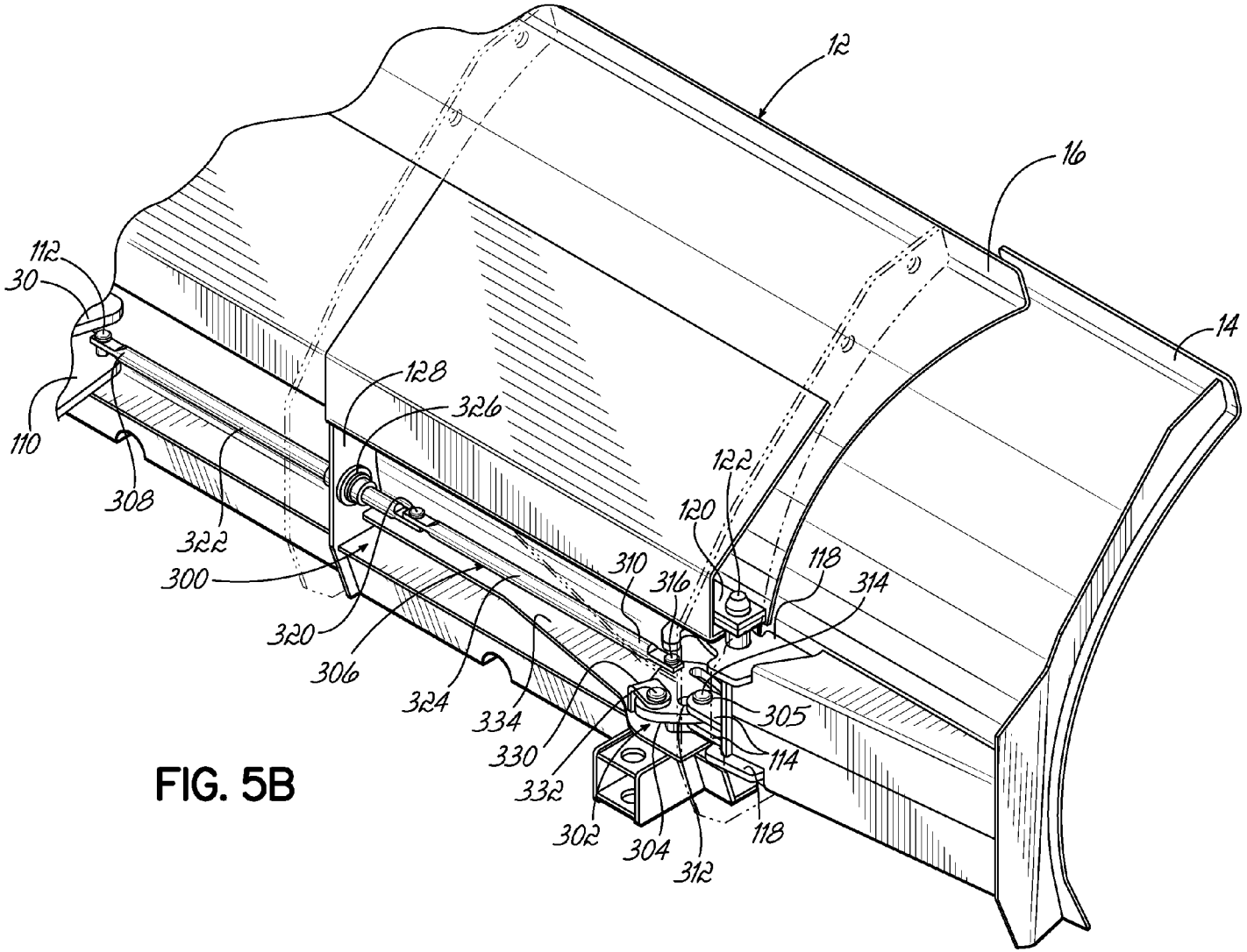
FIG. 5B is a view similar to FIG. 5A but with the first plow wing generally parallel to the plow blade.

Referring now to FIGS. 5A and 5B, another connecting member 300 is illustrated that is configured to pivot the first plow wing 14 relative to the plow blade 12 during pivoting of the plow blade 12 relative to the vehicle as shown in FIGS. 2A, 2B, and 2C. Connecting member 300 comprises a cam and follower mechanism 302. The cam and follower mechanism 302 can comprise a cam 304 pivotally mounted to the plow blade 12, a cam follower 305 mounted on the first plow wing 14, and a link 306 having a first end 308 connected to the plow support 22 and having a second end 310 connected to the cam 304. The cam 304 can include an arcuate slot 312 therein defining a cam profile, and the cam follower 305 can be a pin 314 positioned in the slot 312. First end 308 of link 306 can be pivotally connected to the lower plate 100 of clevis 30 with pin 112. Second end 310 of first link 306 can be pivotally connected to the cam 304 with a pin 316. Pin 314 can be connected to the pair of ears 114, 114 of the first plow wing 14. The link 306 can be hinged along its length with a pin 320, thus defining a first link portion 322 and a second link portion 324. First link portion 322 can be supported in a grommet 326 installed in a hole in the rib 128 of the plow blade 12. Cam 304 can be pivotally mounted to a bracket 330 with a pin 332. Bracket 330 can be mounted to a rib 334 of the plow blade 12. The cam profile of the slot 312 can be designed to pivot the first plow wing 14 relative to the plow blade 12 as shown in FIGS. 2A, 2B, and 2C, or other relative movement as desired.

Figure 6A:
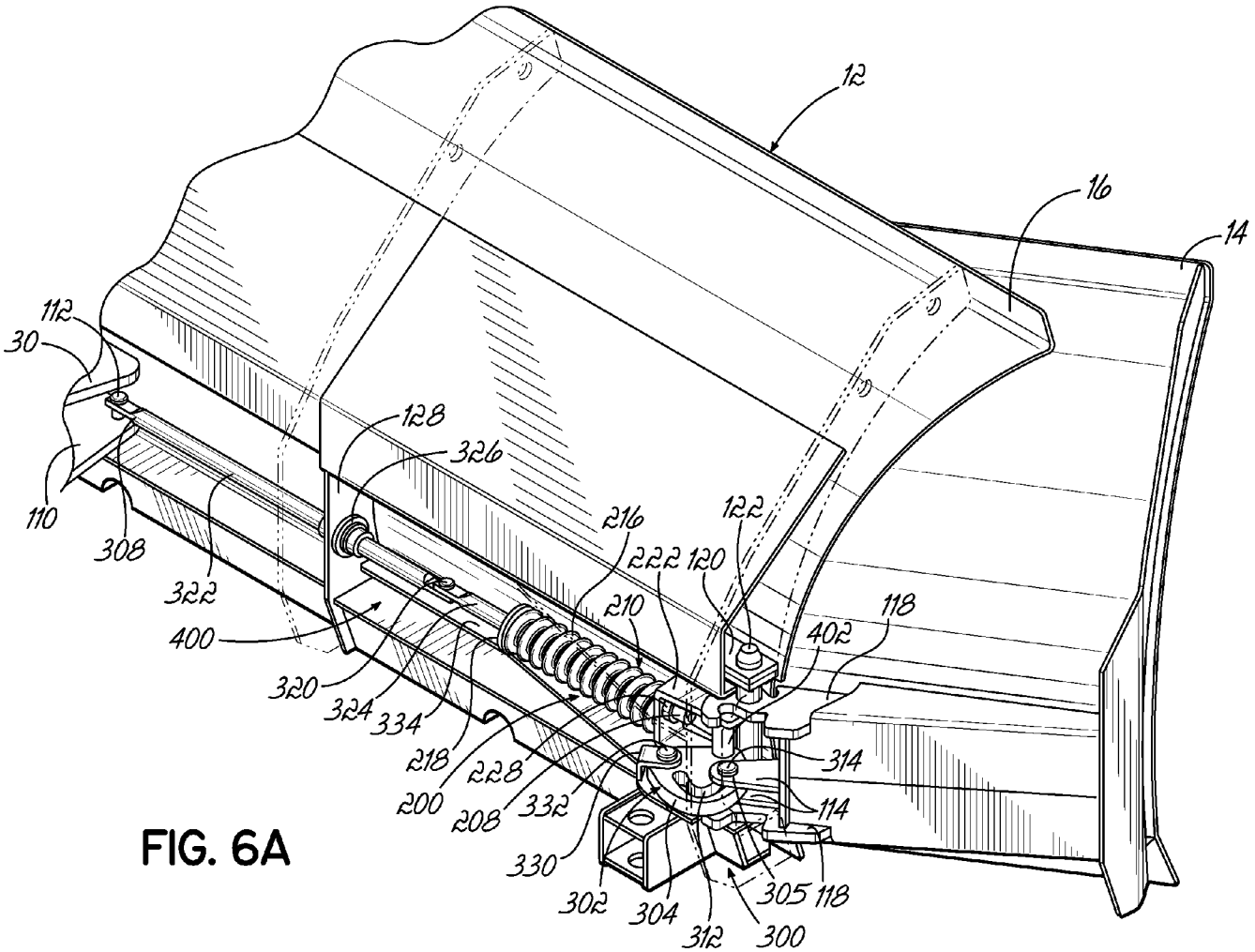
FIG. 6A is an enlarged rear perspective view of the first end of the plow blade and the first plow wing utilizing a cam and follower mechanism and a resilient connecting member to operably connect the first plow wing to the plow support, the resilient connecting member between the cam and follower mechanism and the plow support, the first plow wing angled forwardly relative to the plow blade.
Figure 6B:
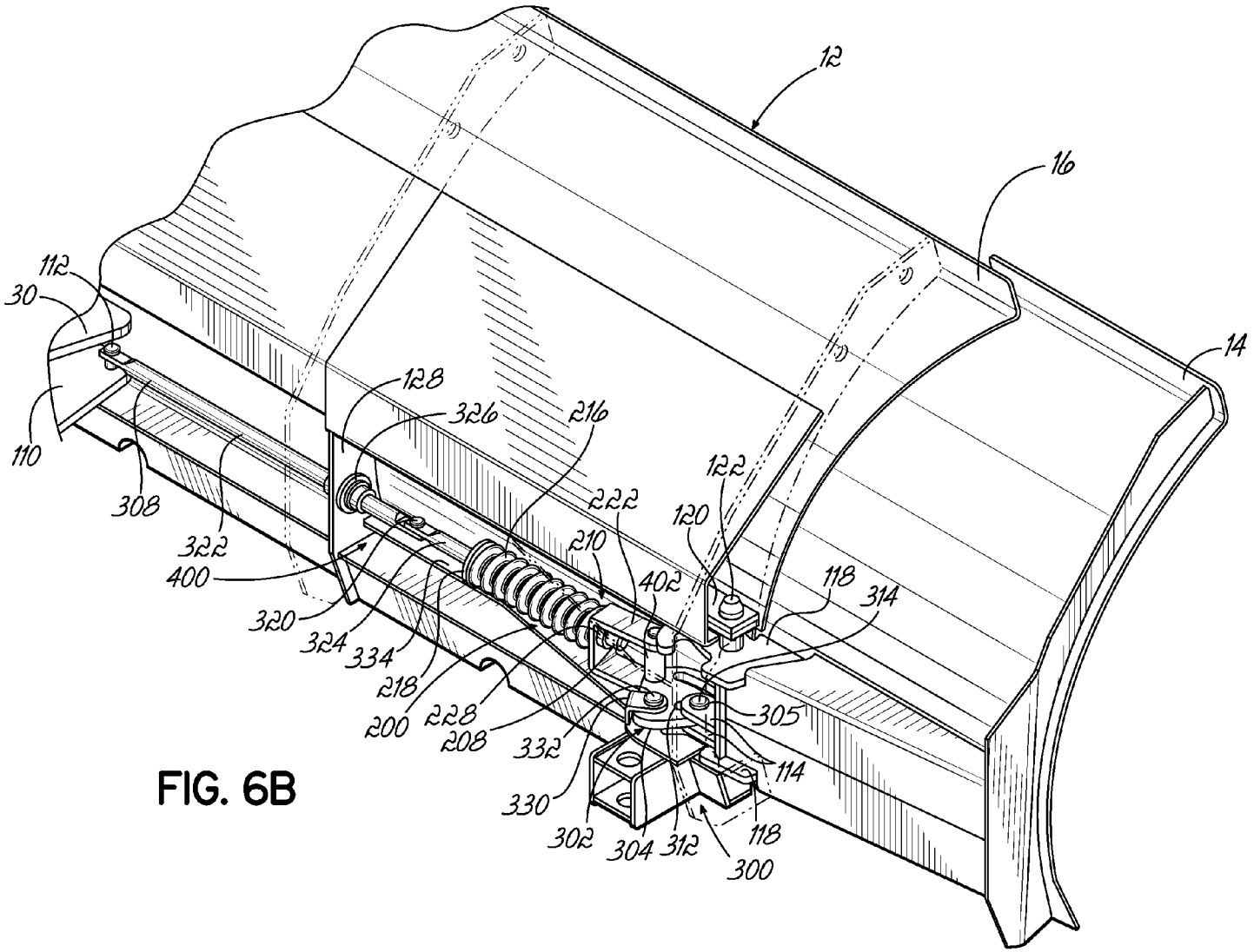
FIG. 6B is a view similar to FIG. 6A but with the first plow wing generally parallel to the plow blade.

Referring now to FIGS. 6A and 6B, another connecting member 400 is illustrated that is configured to pivot the first plow wing 14 relative to the plow blade 12 during pivoting of the plow blade 12 relative to the vehicle as shown in FIGS. 2A, 2B, and 2C. Connecting member 400 comprises the prior described resilient connecting member 200 in combination with the prior described cam and follower mechanism 300. The connecting member 400 thus comprises the prior described cam 304 and follower 305, in conjunction with the prior described link rod with threaded end 208 and spring seat 218, spring guide with tube 220 and clevis 222, and compression spring 216. The sides 234, 236 of the clevis 222 are pivotally connected to the cam 304 with pin 402. Thus, in this embodiment, the cam and follower mechanism 300 is in an outboard position and the resilient connecting member 200 is in an inboard position, such that the resilient connecting member 200 is operably connected between the cam and follower mechanism 300 and the plow support 22.

Figure 7A:
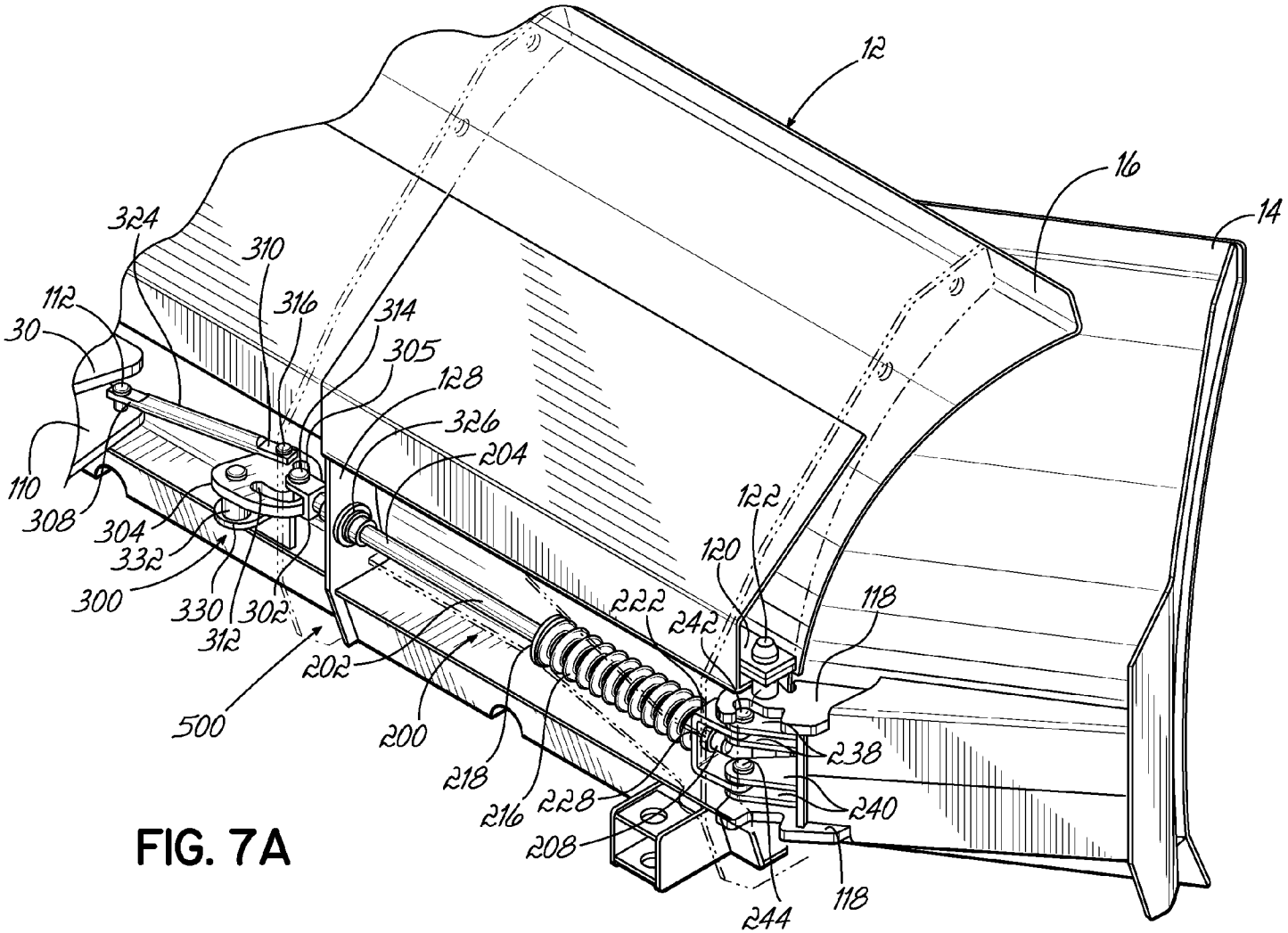
FIG. 7A is an enlarged rear perspective view of the first end of the plow blade and the first plow wing utilizing a cam and follower mechanism and a resilient connecting member to operably connect the first plow wing to the plow support, the resilient connecting member between the cam and follower mechanism and the first plow wing, the first plow wing angled forwardly relative to the plow blade.
Figure 7B:
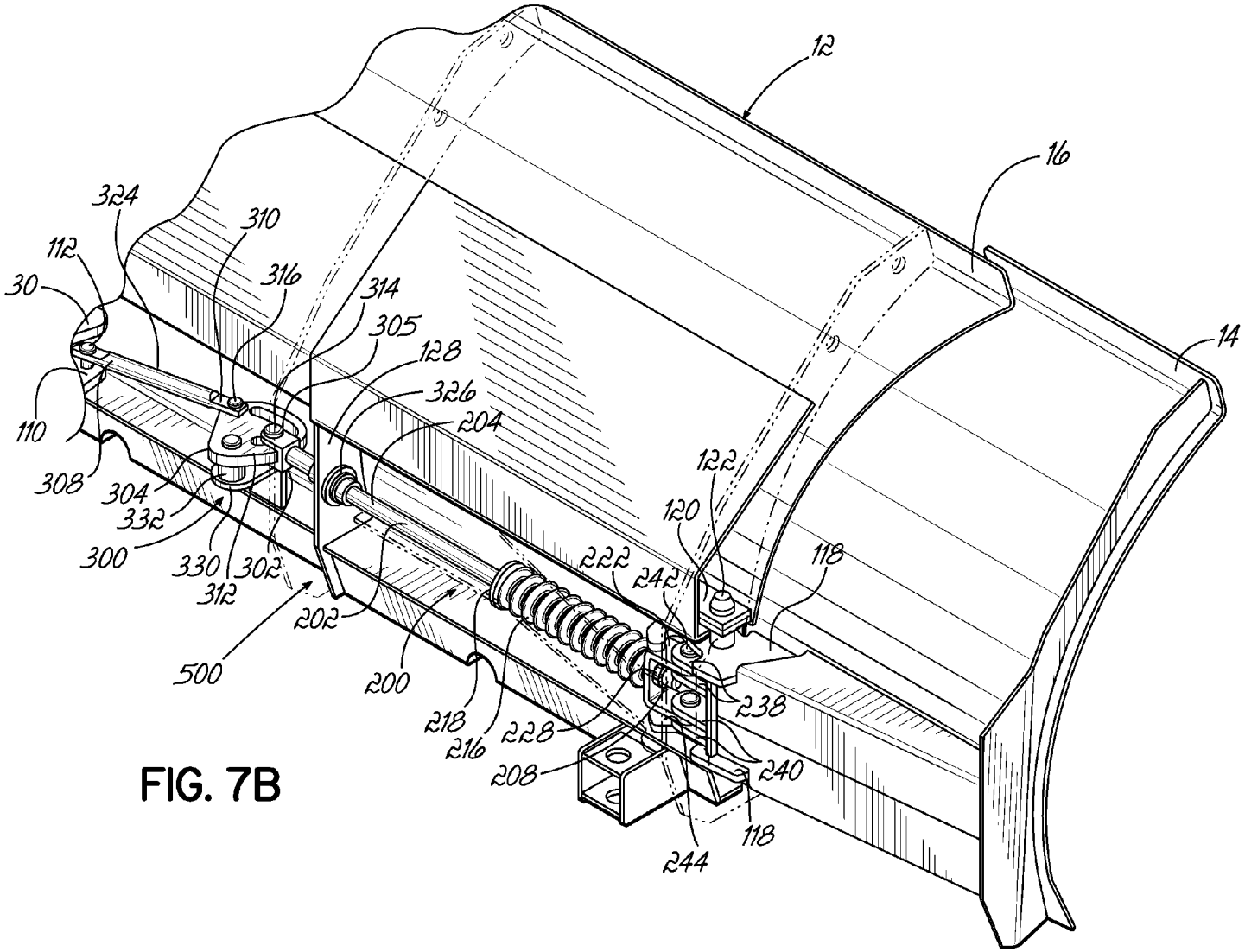
FIG. 7B is a view similar to FIG. 7A but with the first plow wing generally parallel to the plow blade.

Referring now to FIGS. 7A and 7B, another connecting member 500 is illustrated that is configured to pivot the first plow wing 14 relative to the plow blade 12 during pivoting of the plow blade 12 relative to the vehicle as shown in FIGS. 2A, 2B, and 2C. Connecting member 500 comprises the prior described resilient connecting member 200 in combination with the prior described cam and follower mechanism 300. The connecting member 500 thus comprises the prior described cam 304 and follower 305, in conjunction with the prior described link rod with threaded end 208 and spring seat 218, spring guide with tube 220 and clevis 222, and compression spring 216. The cam follower 305 is carried by a clevis 502 on the end 206 of the link 204. Thus, in this embodiment, the resilient connecting member 200 is in the outboard position and the cam and follower mechanism 300 is in the inboard position, such that the resilient connecting member 200 is operably connected between the cam and follower mechanism 300 and the first plow wing 14.

The embodiments shown and described are merely for illustrative purposes only. The drawings and the description are not intended to limit in any way the scope of the claims. Those skilled in the art will appreciate various changes, modifications, and other embodiments. All such changes, modifications and embodiments are deemed to be embraced by the claims. Accordingly, the scope of the right to exclude shall be limited only by the following claims and their equivalents.

What is claimed is:

1. A plow assembly for attachment to a vehicle, the vehicle having a longitudinal axis, said plow assembly comprising:

a plow blade having first and second ends, a first plow wing pivotally mounted to said first end of said plow blade, a plow support adapted to be mounted to the vehicle, said plow blade being pivotally mounted to said plow support to permit said plow blade to pivot relative to the vehicle between a center position, where said plow blade is positioned generally perpendicular to the longitudinal axis of the vehicle, and a first position, where said first end of said plow blade is pivoted toward the vehicle, and between said center position and a second position, where said second end of said plow blade is pivoted toward the vehicle, and a first connecting member connected to said first plow wing and to said plow support, said first connecting member configured to pivot said first plow wing relative to said plow blade during pivoting of said plow blade relative to the vehicle such that when said plow blade is in said center position said first plow wing is angled forwardly relative to said plow blade, when said plow blade is in said first position said first plow wing is generally parallel to said plow blade, and when said plow blade is in said second position said first plow wing is angled forwardly relative to said plow blade, said first connecting member comprising a first single link rod directly connected to said first plow wing and to said plow support.

2. The plow assembly of claim 1 wherein said plow support comprises an A-frame having a forward end and a rearward end, said plow blade pivotally mounted to said forward end of said A-frame, said rearward end of said A-frame adapted to be mounted to the vehicle.

3. The plow assembly of claim 1 wherein said first plow wing is angled forwardly relative to said plow blade by a greater degree when said plow blade is in said second position than when said plow blade is in said center position.

4. The plow assembly of claim 3 wherein said first plow wing is angled forwardly relative to said plow blade by an angle of about 33 degrees relative to said plow blade when said plow blade is in said center position, and wherein said first plow wing is angled forwardly relative to said plow blade by an angle of about 42 degrees relative to said plow blade when said plow blade is in said second position.

5. The plow assembly of claim 1 further comprising a first actuator connected to said plow blade and to said plow support, said first actuator connected to said plow blade at a location between a pivot axis of said plow blade and said first end of said plow blade.

6. The plow assembly of claim 1 wherein said first single link rod has a first end connected to said plow support at a location forward of a pivot axis of said plow blade and between the pivot axis of said plow blade and said first end of said plow blade, and wherein said first single link rod has a second end connected to said first plow wing at a location rearward of a pivot axis of said first plow wing.

7. The plow assembly of claim 1 further comprising:

a second plow wing pivotally mounted to said second end of said plow blade, and a second connecting member connected to said second plow wing and to said plow support, said second connecting member configured to pivot said second plow wing relative to said plow blade during pivoting of said plow blade relative to the vehicle such that when said plow blade is in said center position said second plow wing is angled forwardly relative to said plow blade, when said plow blade is in said first position said second plow wing is angled forwardly relative to said plow blade, and when said plow blade is in said second position said second plow wing is generally parallel to said plow blade, said second connecting member comprising a second single link rod directly connected to said second plow wing and to said plow support.

8. The plow assembly of claim 7 wherein said second plow wing is angled forwardly relative to said plow blade by a greater degree when said plow blade is in said first position than when said plow blade is in said center position.

9. The plow assembly of claim 8 wherein said second plow wing is angled forwardly relative to said plow blade by an angle of about 33 degrees relative to said plow blade when said plow blade is in said center position, and wherein said second plow wing is angled forwardly relative to said plow blade by an angle of about 42 degrees relative to said plow blade when said plow blade is in said first position.

10. The plow assembly of claim 7 further comprising a second actuator connected to said plow blade and to said plow support, said second actuator connected to said plow blade at a location between a pivot axis of said plow blade and said second end of said plow blade.

11. The plow assembly of claim 7 wherein said second single link rod has a first end connected to said plow support at a location forward of a pivot axis of said plow blade and between the pivot axis of said plow blade and said first end of said plow blade, and wherein said second single link rod has a second end connected to said second plow wing at a location rearward of a pivot axis of said second plow wing.

12. A plow assembly for attachment to a vehicle, the vehicle having a longitudinal axis, said plow assembly comprising:

a plow blade having first and second ends, a first plow wing pivotally mounted to said first end of said plow blade, a plow support adapted to be mounted to the vehicle, said plow blade being pivotally mounted to said plow support to permit said plow blade to pivot relative to the vehicle between a center position, where said plow blade is positioned generally perpendicular to the longitudinal axis of the vehicle, and a first position, where said first end of said plow blade is pivoted toward the vehicle, and between said center position and a second position, where said second end of said plow blade is pivoted toward the vehicle, and a first connecting member operably connected to said first plow wing and to said plow support, said first connecting member configured to pivot said first plow wing relative to said plow blade during pivoting of said plow blade relative to the vehicle such that when said plow blade is in said center position said first plow wing is angled forwardly relative to said plow blade, when said plow blade is in said first position said first plow wing is generally parallel to said plow blade, and when said plow blade is in said second position said first plow wing is angled forwardly relative to said plow blade, said first connecting member comprising a first resilient connecting member such that when said first plow wing contacts an obstacle during forward movement of the vehicle, said first resilient connecting member shortens to allow said first plow wing to pivot toward said plow support until such time as said first plow wing no longer contacts the obstacle at which time said first resilient connecting member lengthens to pivot said first plow wing away from said plow support.

13. The plow assembly of claim 12 wherein said plow support comprises an A-frame having a forward end and a rearward end, said plow blade pivotally mounted to said forward end of said A-frame, said rearward end of said A-frame adapted to be mounted to the vehicle.

14. The plow assembly of claim 12 wherein said first plow wing is angled forwardly relative to said plow blade by a greater degree when said plow blade is in said second position than when said plow blade is in said center position.

15. The plow assembly of claim 14 wherein said first plow wing is angled forwardly relative to said plow blade by an angle of about 33 degrees relative to said plow blade when said plow blade is in said center position, and wherein said first plow wing is angled forwardly relative to said plow blade by an angle of about 42 degrees relative to said plow blade when said plow blade is in said second position.

16. The plow assembly of claim 12 further comprising a first actuator connected to said plow blade and to said plow support, said first actuator connected to said plow blade at a location between a pivot axis of said plow blade and said first end of said plow blade.

17. The plow assembly of claim 12 wherein said first resilient connecting member comprises:

a first link having first and second ends, a second link having first and second ends, said first end of said first link connected to said plow support, said first end of said second link connected to said first wing, said second ends of said first and second links movably connected to each other such that said first resilient connecting member has a longer length and a shorter length, and a compression spring operable between said second ends of said first and second links.

18. The plow assembly of claim 17, wherein said first link comprises a link rod having a threaded end and a spring seat spaced from said threaded end, wherein said second link comprises a spring guide having a tube and a clevis attached to an end of said tube, said tube and clevis positioned to telescope over said link rod such that said threaded end of said link rod extends out of said tube and a base of said clevis, and a nut threaded on said threaded end of said link rod and abutting one side of said base of said clevis, said compression spring positioned over said tube of said spring guide, one end of said compression spring abutting the other side of said base of said clevis, the other end of said compression spring abutting said spring seat of said link rod.

19. The plow assembly of claim 12 further comprising:

a second plow wing pivotally mounted to said second end of said plow blade, and a second connecting member operably connected to said second plow wing and to said plow support, said second connecting member configured to pivot said second plow wing relative to said plow blade during pivoting of said plow blade relative to the vehicle such that when said plow blade is in said center position said second plow wing is angled forwardly relative to said plow blade, when said plow blade is in said first position said second plow wing is angled forwardly relative to said plow blade, and when said plow blade is in said second position said second plow wing is generally parallel to said plow blade, said second connecting member comprising a second resilient connecting member such that when said second plow wing contacts an obstacle during forward movement of the vehicle, said second resilient connecting member shortens to allow said second plow wing to pivot toward said plow support until such time as said second plow wing no longer contacts the obstacle at which time said second resilient connecting member lengthens to pivot said second plow wing away from said plow support.

20. The plow assembly of claim 19 wherein said second plow wing is angled forwardly relative to said plow blade by a greater degree when said plow blade is in said first position than when said plow blade is in said center position.

21. The plow assembly of claim 20 wherein said second plow wing is angled forwardly relative to said plow blade by an angle of about 33 degrees relative to said plow blade when said plow blade is in said center position, and wherein said second plow wing is angled forwardly relative to said plow blade by an angle of about 42 degrees relative to said plow blade when said plow blade is in said first position.

22. The plow assembly of claim 19 further comprising a second actuator connected to said plow blade and to said plow support, said second actuator connected to said plow blade at a location between a pivot axis of said plow blade and said second end of said plow blade.

23. The plow assembly of claim 19 wherein said second resilient connecting member comprises:

a first link having first and second ends, a second link having first and second ends, said first end of said first link connected to said plow support, said first end of said second link connected to said second wing, said second ends of said first and second links movably connected to each other such that said second resilient connecting member has a longer length and a shorter length, and a compression spring operable between said second ends of said first and second links.

24. The plow assembly of claim 23, wherein said first link comprises a link rod having a threaded end and a spring seat spaced from said threaded end, wherein said second link comprises a spring guide having a tube and a clevis attached to an end of said tube, said tube and clevis positioned to telescope over said link rod such that said threaded end of said link rod extends out of said tube and a base of said clevis, and a nut threaded on said threaded end of said link rod and abutting one side of said base of said clevis, said compression spring positioned over said tube of said spring guide, one end of said compression spring abutting the other side of said base of said clevis, the other end of said compression spring abutting said spring seat of said link rod.

25. A plow assembly for attachment to a vehicle, the vehicle having a longitudinal axis, said plow assembly comprising:

a plow blade having first and second ends, a first plow wing pivotally mounted to said first end of said plow blade, a plow support adapted to be mounted to the vehicle, said plow blade being pivotally mounted to said plow support to permit said plow blade to pivot relative to the vehicle between a center position, where said plow blade is positioned generally perpendicular to the longitudinal axis of the vehicle, and a first position, where said first end of said plow blade is pivoted toward the vehicle, and between said center position and a second position, where said second end of said plow blade is pivoted toward the vehicle, and a first connecting member operably connected to said first plow wing and to said plow support, said first connecting member configured to pivot said first plow wing relative to said plow blade during pivoting of said plow blade relative to the vehicle such that when said plow blade is in said center position said first plow wing is angled forwardly relative to said plow blade, when said plow blade is in said first position said first plow wing is generally parallel to said plow blade, and when said plow blade is in said second position said first plow wing is angled forwardly relative to said plow blade said first connecting member comprising a first cam and follower mechanism.

26. The plow assembly of claim 25 wherein said plow support comprises an A-frame having a forward end and a rearward end, said plow blade pivotally mounted to said forward end of said A-frame, said rearward end of said A-frame adapted to be mounted to the vehicle.

27. The plow assembly of claim 25 wherein said first plow wing is angled forwardly relative to said plow blade by a greater degree when said plow blade is in said second position than when said plow blade is in said center position.

28. The plow assembly of claim 27 wherein said first plow wing is angled forwardly relative to said plow blade by an angle of about 33 degrees relative to said plow blade when said plow blade is in said center position, and wherein said first plow wing is angled forwardly relative to said plow blade by an angle of about 42 degrees relative to said plow blade when said plow blade is in said second position.

29. The plow assembly of claim 25 further comprising a first actuator connected to said plow blade and to said plow support, said first actuator connected to said plow blade at a location between a pivot axis of said plow blade and said first end of said plow blade.

30. The plow assembly of claim 25 wherein said first cam and follower mechanism comprises:

a cam pivotally mounted to said plow blade, a cam follower mounted on said first plow wing, and a link having a first end connected to said plow support and having a second end connected to said cam.

31. The plow assembly of claim 30 wherein said cam includes an arcuate slot therein defining a cam profile, and wherein said cam follower is a pin positioned in said slot.

32. The plow assembly of claim 25 wherein said first cam and follower mechanism comprises:

a cam pivotally mounted to said plow blade, a cam follower, a cam link having a first end connected to said plow support and having a second end connected to said cam, and a follower link having a first end connected to said first plow wing and having a second end connected to said cam follower.

33. The plow assembly of claim 32 wherein said cam includes an arcuate slot therein defining a cam profile, and wherein said cam follower is a pin positioned in said slot.

34. The plow assembly of claim 25 further comprising:

a second plow wing pivotally mounted to said second end of said plow blade, and a second connecting member operably connected to said second plow wing and to said plow support, said second connecting member configured to pivot said second plow wing relative to said plow blade during pivoting of said plow blade relative to the vehicle such that when said plow blade is in said center position said second plow wing is angled forwardly relative to said plow blade, when said plow blade is in said first position said second plow wing is angled forwardly relative to said plow blade, and when said plow blade is in said second position said second plow wing is generally parallel to said plow blade, said second connecting member comprising a second cam and follower mechanism.

35. The plow assembly of claim 34 wherein said second plow wing is angled forwardly relative to said plow blade by a greater degree when said plow blade is in said first position than when said plow blade is in said center position.

36. The plow assembly of claim 35 wherein said second plow wing is angled forwardly relative to said plow blade by an angle of about 33 degrees relative to said plow blade when said plow blade is in said center position, and wherein said second plow wing is angled forwardly relative to said plow blade by an angle of about 42 degrees relative to said plow blade when said plow blade is in said first position.

37. The plow assembly of claim 34 further comprising a second actuator connected to said plow blade and to said plow support, said second actuator connected to said plow blade at a location between a pivot axis of said plow blade and said second end of said plow blade.

38. The plow assembly of claim 34 wherein said second cam and follower mechanism comprises:

a cam pivotally mounted to said plow blade, a cam follower mounted on said second plow wing, and a link having a first end connected to said plow support and having a second end connected to said cam.

39. The plow assembly of claim 38 wherein said cam includes an arcuate slot therein defining a cam profile, and wherein said cam follower is a pin positioned in said slot.

40. The plow assembly of claim 34 wherein said second cam and follower mechanism comprises:

a cam pivotally mounted to said plow blade, a cam follower, a cam link having a first end connected to said plow support and having a second end connected to said cam, and a follower link having a first end connected to said second plow wing and having a second end connected to said cam follower.

41. The plow assembly of claim 40 wherein said cam includes an arcuate slot therein defining a cam profile, and wherein said cam follower is a pin positioned in said slot.

42. A plow assembly for attachment to a vehicle, the vehicle having a longitudinal axis, said plow assembly comprising:

a plow blade having first and second ends, a first plow wing pivotally mounted to said first end of said plow blade, a plow support adapted to be mounted to the vehicle, said plow blade being pivotally mounted to said plow support to permit said plow blade to pivot relative to the vehicle between a center position, where said plow blade is positioned generally perpendicular to the longitudinal axis of the vehicle, and a first position, where said first end of said plow blade is pivoted toward the vehicle, and between said center position and a second position, where said second end of said plow blade is pivoted toward the vehicle, a first cam and follower mechanism operably connected to said first plow wing and to said plow support, said first cam and follower mechanism configured to pivot said first plow wing relative to said plow blade during pivoting of said plow blade relative to the vehicle such that when said plow blade is in said center position said first plow wing is angled forwardly relative to said plow blade, when said plow blade is in said first position said first plow wing is generally parallel to said plow blade, and when said plow blade is in said second position said first plow wing is angled forwardly relative to said plow blade, and a first resilient connecting member operably connected between one of 1) said first cam and follower mechanism and said plow support, and 2) said first cam and follower mechanism and said first plow wing, said first resilient connecting member configured such that when said first plow wing contacts an obstacle during forward movement of the vehicle, said first resilient connecting member shortens to allow said first plow wing to pivot toward said plow support until such time as said first plow wing no longer contacts the obstacle at which time said first resilient connecting member lengthens to pivot said first plow wing away from said plow support.

43. The plow assembly of claim 42 wherein said plow support comprises an A-frame having a forward end and a rearward end, said plow blade pivotally mounted to said forward end of said A-frame, said rearward end of said A-frame adapted to be mounted to the vehicle.

44. The plow assembly of claim 42 wherein said first plow wing is angled forwardly relative to said plow blade by a greater degree when said plow blade is in said second position than when said plow blade is in said center position.

45. The plow assembly of claim 42 wherein said first plow wing is angled forwardly relative to said plow blade by an angle of about 33 degrees relative to said plow blade when said plow blade is in said center position, and wherein said first plow wing is angled forwardly relative to said plow blade by an angle of about 42 degrees relative to said plow blade when said plow blade is in said second position.

46. The plow assembly of claim 42 further comprising a first actuator connected to said plow blade and to said plow support, said first actuator connected to said plow blade at a location between a pivot axis of said plow blade and said first end of said plow blade.

47. The plow assembly of claim 42 wherein said first cam and follower mechanism comprises:

a cam pivotally mounted to said plow blade, a cam follower mounted on said first plow wing, and a link having a first end connected to said plow support and having a second end connected to said cam.

48. The plow assembly of claim 47 wherein said cam includes an arcuate slot therein defining a cam profile, and wherein said cam follower is a pin positioned in said slot.

49. The plow assembly of claim 42 wherein said first cam and follower mechanism comprises:

a cam pivotally mounted to said plow blade, a cam follower, a cam link having a first end connected to said plow support and having a second end connected to said cam, and a follower link having a first end connected to said first plow wing and having a second end connected to said cam follower.

50. The plow assembly of claim 49 wherein said cam includes an arcuate slot therein defining a cam profile, and wherein said cam follower is a pin positioned in said slot.

51. The plow assembly of claim 42 wherein said first resilient connecting member comprises:

a first link having first and second ends, a second link having first and second ends, said first end of said first link connected to said plow support, said first end of said second link connected to said first wing, said second ends of said first and second links movably connected to each other such that said first resilient connecting member has a longer length and a shorter length, and a compression spring operable between said second ends of said first and second links.

52. The plow assembly of claim 51, wherein said first link comprises a link rod having a threaded end and a spring seat spaced from said threaded end, wherein said second link comprises a spring guide having a tube and a clevis attached to an end of said tube, said tube and clevis positioned to telescope over said link rod such that said threaded end of said link rod extends out of said tube and a base of said clevis, and a nut threaded on said threaded end of said link rod and abutting one side of said base of said clevis, said compression spring positioned over said tube of said spring guide, one end of said compression spring abutting the other side of said base of said clevis, the other end of said compression spring abutting said spring seat of said link rod.

* * * * *